US007891419B2

(12) United States Patent
Shewchuk

(10) Patent No.: US 7,891,419 B2
(45) Date of Patent: Feb. 22, 2011

(54) DOWNHOLE WELL CLEANING TOOL

(76) Inventor: Daren Shewchuk, PO Box 1174, Preeceville, SK (CA) S0A 3B0

( * ) Notice: Subject to any disclaimer, the term of this patent is extended or adjusted under 35 U.S.C. 154(b) by 0 days.

(21) Appl. No.: 12/352,101

(22) Filed: Jan. 12, 2009

(65) Prior Publication Data

US 2009/0178799 A1 Jul. 16, 2009

(30) Foreign Application Priority Data

Jan. 10, 2008 (CA) ..... 2620319

(51) Int. Cl.
*E21B 37/00* (2006.01)

(52) U.S. Cl. ..... 166/105.3; 166/311

(58) Field of Classification Search ..... 166/105.3, 166/105.2, 311; 175/234
See application file for complete search history.

(56) References Cited

U.S. PATENT DOCUMENTS 974,342 A * 11/1910 Bell ..... 166/105.3
4,940,092 A 7/1990 Ferguson
5,095,976 A * 3/1992 Appleton ..... 166/105.1
5,119,874 A * 6/1992 Ferguson et al. ..... 166/105.2

* cited by examiner

*Primary Examiner*—Hoang Dang
(74) *Attorney, Agent, or Firm*—Kyle R. Satterthwaite; Ryan W. Dupuis; Ade & Company Inc.

(57) ABSTRACT

A downhole well cleaning tool adapted for connection between upper and lower sections of an elongate string includes a pump barrel having at least one fluid outlet proximate its upper end. A swab assembly is connected to a pump mandrel for reciprocation within the pump barrel to pump fluids upward to the outlet to draw fluid and debris into the lower string section and trap the debris. A lower portion of the swab mandrel is hollow and open at a lower end thereof with at least one conduit extending through a side wall of the swab mandrel to direct fluid laterally outward from the hollow lower portion against the side wall of the pump barrel during lowering into fluid to reduce debris build-up within the pump barrel. A wear bushing is mounted between the pump mandrel and barrel and a knuckle or swivel joint connects the swab and pump mandrels.

20 Claims, 6 Drawing Sheets

DOWNHOLE WELL CLEANING TOOL

This application claims foreign priority benefits from Canadian Patent Application No. 2,620,319 filed Jan. 10, 2008.

FIELD OF THE INVENTION

The present invention relates generally to a tool for lowering into a wellbore on a string to remove debris from the bottom of the wellbore, and more particularly to a tool using a swab assembly reciprocally disposed within a ported pump barrel to draw debris-carrying fluid into lower sections of the string through a check valve.

BACKGROUND OF THE INVENTION

A number of devices have been designed for the purpose of cleaning out debris having collected at the bottom of a wellbore, as such a deposit can have severely detrimental effect on the flow of production fluids from the well.

U.S. Pat. No. 4,940,092 teaches a well clean out tool connected in series in a drill string and featuring a swab assembly reciprocally supported within a pump barrel at the end of a pump mandrel connected through upper sections of the drill string to a rotational and reciprocal drive source at the surface. The pump barrel is ported near its top end to discharge fluids lifted within it by the swab cups during an upstroke of the tool, the lifting of this fluid reducing pressure within the pump barrel below the swab cup so as to open a check valve disposed in a trapper sub connected below the pump barrel, through which debris-carrying fluid enters the debris-trapping sub to remove the debris from the surrounding bottom region of the wellbore into which the string has been lowered.

The prior art tool may be prone to debris build-up within the pump barrel should any debris carried into the trapper sub not be retained therein, which would require removal of the tool from the wellbore for disassembly and subsequent cleaning of the pump barrel. Furthermore, damage may be caused to the inner surface of the pump barrel wall by contact therewith by the lower end of the swab mandrel under flexing that may be experienced during reciprocation of the pump mandrel and upper string sections.

SUMMARY OF THE INVENTION

According to a first aspect of the invention there is provided a downhole well cleaning tool adapted for connection between upper sections and a hollow lower section of an elongate string extendable down into a wellbore lower section first, the lower section comprising an inlet spaced from an end of the lower section nearest the upper sections and equipped with a check valve to selectively open and close the inlet and the upper section being connectable to a drive source operable to reciprocate the upper sections along the wellbore, the clean out tool comprising:

an elongate tubular pump barrel connectable at a lower end thereof in fluid communication with the hollow lower section of the elongate string and having at least one fluid outlet through a side wall near of the pump barrel proximate an upper end thereof, an elongate pump mandrel connectable at and upper end thereof to the upper sections of the elongate string and extending through the upper end of the pump barrel, the pump mandrel and the pump barrel being arranged to allow reciprocal motion of the pump mandrel relative to and along the pump barrel while preventing relation rotation between the pump barrel and the pump mandrel; and a swab assembly connected at an upper end thereof to a lower end of the pump mandrel and reciprocally contained within the pump barrel, the swab assembly comprising a swab mandrel having at least one longitudinal bypass channel extending therealong and a swab cup disposed about and slidable along the swab mandrel between upper and lower stops defined thereon to limit sliding motion of the swab between uppermost and lowermost positions in which fluid flow from one side of the swab cup to an opposite side thereof through the bypass channel is allowed and prevented respectively, the swab cup sealing against an interior of the side wall of the pump barrel in the lowermost position to seal off fluid flow from the one side of the swab cup to the opposite side thereof between the swab cup and the side wall of the pump barrel;

a lower portion of the swab mandrel being hollow and open at a lower end thereof, at least one conduit extending through a side wall of the swab mandrel to communicate an interior of the hollow lower portion thereof with an exterior thereof to direct fluid laterally outward from the interior of the hollow lower portion of the swab mandrel against the side wall of the pump barrel during lowering thereof into fluid within the wellbore The present invention performs a self-cleaning action provided by the arrangement of a hollow cavity extending into the swab mandrel from the bottom thereof with conduits projecting laterally outward therefrom to the exterior of the pump mandrel. When the swab mandrel is lowered through surrounding fluid within the pump barrel, fluid is directed outward from the swab mandrel against the surrounding interior surface of the pump barrel to knock off debris that has been deposited thereon during reciprocal driving of the swab mandrel to draw debris-carrying fluid into the lower sections of the string to remove debris from the wellbore. The debris knocked free by the jetting action from the conduits is effectively carried upward for discharge from the pump barrel through the outlet proximate the top of thereof by the relative flow of fluid upward past the swab cup through the bypass channels extending through its central opening during the downstroke of the pump mandrel moving the swab mandrel down along the pump barrel in the interior thereof. The tool thereby improves on prior art tools using the same basic operation of a reciprocating swab assembly within a pump barrel by adding features that under such operation will automatically help flush the pump barrel clean.

Preferably the at least one conduit extending through the side wall of the swab mandrel is angled obliquely upward from the interior of the hollow lower portion relative to a longitudinal axis of the swab mandrel.

Preferably the at least one conduit comprises a plurality of conduits opening at an outer surface of the side wall of the swab mandrel at locations spaced about the periphery thereof.

Preferably each conduit is smaller in diameter than the interior of the hollow lower portion of the swab mandrel.

Preferably the interior of the hollow lower portion of the swab mandrel flares outwardly toward a lower end of the swab mandrel to define a maximum diameter of the interior at an inlet thereof.

Preferably there is provided a movable joint connecting the pump mandrel and the swab mandrel to allow movement of the swab mandrel into and out of alignment with a longitudinal axis of the pump mandrel.

Preferably the swab mandrel is connected to the to the pump mandrel by a knuckle or swivel joint.

Preferably there is provided a wear bushing mounted to the pump mandrel at a position therealong.

Preferably the wear bushing is positioned proximate the lower end of the pump mandrel.

Preferably the wear bushing has at least one passage extending from one side of the wear bushing to an opposite side of the wear bushing along the pump mandrel to allow fluid flow upward past the wear bushing.

Preferably the at least one passage of the wear bushing comprises at least one groove in an outer periphery of the wear bushing.

Preferably the wear bushing comprises a brass bushing.

The wear bushing, by filling space between the pump mandrel and the surrounding pump barrel wall helps maintain co-axial alignment between the pump mandrel and the pump barrel to reduce the potential for contact of either mandrel with the pump barrel wall and damage caused thereby.

Preferably the pump mandrel and an opening in the closed upper end of the pump barrel each have a straight-sided cross-sectional shape.

Preferably the cross-sectional shape is hexagonal.

Preferably there is provided a drive sub connecting the pump mandrel and the upper sections of the elongate string, the drive sub receiving the upper end of the pump mandrel in a hollow receiving end of the drive sub and having holes projecting from a periphery of the drive sub into the hollow receiving end to receive set screws for engagement thereof with the pump mandrel proximate the upper end thereof.

Preferably the pump mandrel comprises recesses in a periphery thereof proximate the upper end of the pump mandrel at spaced positions thereabout to receive engagement ends of the set screws.

Preferably the upper end of the pump mandrel is circular in cross section and eternally threaded for connection to an internally threaded sub connecting the pump mandrel and the upper sections of the elongate string.

Preferably each longitudinal bypass channel is defined at the periphery of the swab mandrel, fluid flow along each longitudinal bypass delivering fluid through a central opening in the swab cup between the swab cup and the swab mandrel.

Preferably the swab mandrel is cruciform in cross section, thereby defining four longitudinal bypasses.

Preferably the check valve of the lower section of the drill string with which the tool is used comprises a ball check valve.

According to a second aspect of the invention there is provided a downhole well cleaning tool adapted for connection between upper sections and a hollow lower section of an elongate string extendable down into a wellbore lower section first, the lower section comprising an inlet spaced from an end of the lower section nearest the upper sections and equipped with a check valve to selectively open and close the inlet and the upper section being connectable to a drive source operable to reciprocate the upper sections along the wellbore, the clean out tool comprising:

an elongate tubular pump barrel connectable at a lower end thereof in fluid communication with the hollow lower section of the elongate string and having at least one fluid outlet through a side wall near of the pump barrel proximate an upper end thereof, an elongate pump mandrel connectable at and upper end thereof to the upper sections of the elongate string and extending through the upper end of the pump barrel, the pump mandrel and the pump barrel being arranged to allow reciprocal motion of the pump mandrel relative to and along the pump barrel while preventing relation rotation between the pump barrel and the pump mandrel;

a swab assembly connected at an upper end thereof to a lower end of the pump mandrel and reciprocally contained within the pump barrel, the swab assembly comprising a swab mandrel having at least one longitudinal bypass channel extending therealong and a swab cup disposed about and slidable along the swab mandrel between upper and lower stops defined thereon to limit sliding motion of the swab between uppermost and lowermost positions in which fluid flow from one side of the swab cup to an opposite side thereof through the bypass channel is allowed and prevented respectively, the swab cup sealing against an interior of the side wall of the pump barrel in the lowermost position to seal off fluid flow from the one side of the swab cup to the opposite side thereof between the swab cup and the side wall of the pump barrel; and a wear bushing mounted to the pump mandrel at a position therealong and having at least one passage extending from one side of the wear bushing to an opposite side of the wear bushing along the pump mandrel to allow fluid flow upward past the wear bushing.

According to a third aspect of the invention there is provided a downhole well cleaning tool adapted for connection between upper sections and a hollow lower section of an elongate string extendable down into a wellbore lower section first, the lower section comprising an inlet spaced from an end of the lower section nearest the upper sections and equipped with a check valve to selectively open and close the inlet and the upper section being connectable to a drive source operable to reciprocate the upper sections along the wellbore, the clean out tool comprising:

an elongate tubular pump barrel connectable at a lower end thereof in fluid communication with the hollow lower section of the elongate string and having at least one fluid outlet through a side wall near of the pump barrel proximate an upper end thereof, an elongate pump mandrel connectable at and upper end thereof to the upper sections of the elongate string and extending through the upper end of the pump barrel, the pump mandrel and the pump barrel being arranged to allow reciprocal motion of the pump mandrel relative to and along the pump barrel while preventing relation rotation between the pump barrel and the pump mandrel;

a swab assembly connected at an upper end thereof to a lower end of the pump mandrel and reciprocally contained within the pump barrel, the swab assembly comprising a swab mandrel having at least one longitudinal bypass channel extending therealong and a swab cup disposed about and slidable along the swab mandrel between upper and lower stops defined thereon to limit sliding motion of the swab between uppermost and lowermost positions in which fluid flow from one side of the swab cup to an opposite side thereof through the bypass channel is allowed and prevented respectively, the swab cup sealing against an interior of the side wall of the pump barrel in the lowermost position to seal off fluid flow from the one side of the swab cup to the opposite side thereof between the swab cup and the side wall of the pump barrel; and a movable joint connecting the pump mandrel and the swab mandrel to allow movement of the swab mandrel into and out of alignment with a longitudinal axis of the pump mandrel.

BRIEF DESCRIPTION OF THE DRAWINGS

In the accompanying drawings, which illustrate an exemplary embodiment of the present invention.

DESCRIPTION OF THE PREFERRED EMBODIMENTS

Figure 1:
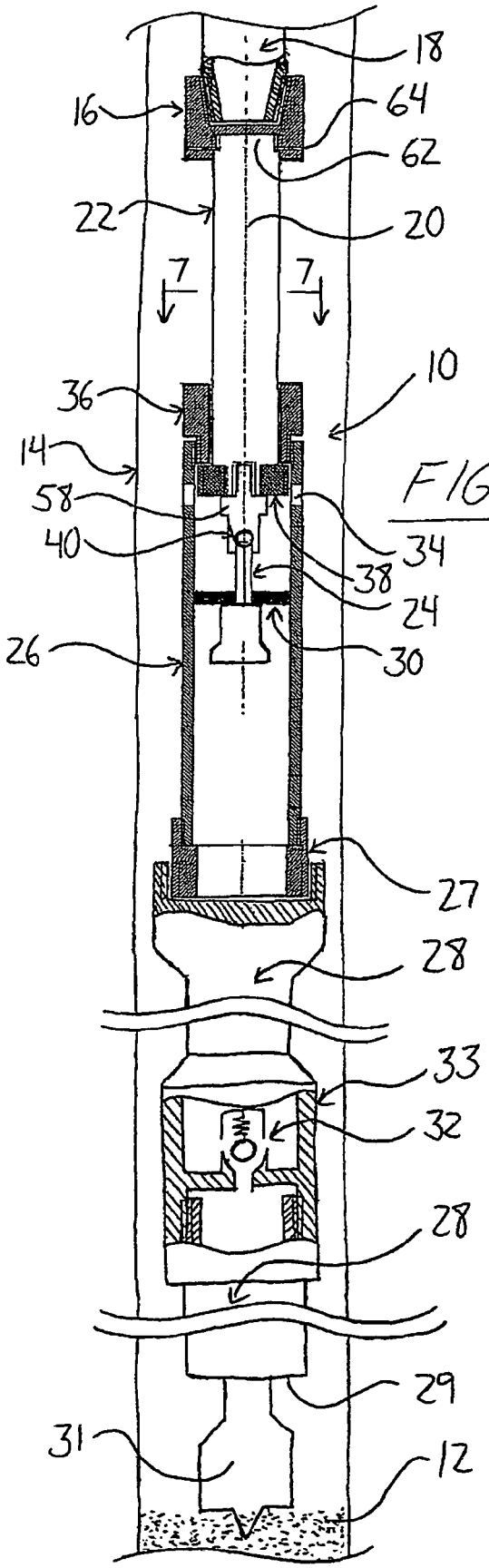
FIG. 1 is a schematic side elevational view of a well cleaning tool in accordance with the present invention in a well bore with a pump mandrel of the cleaning tool in an uppermost position prior to a down stroke.

FIGS. 1 to 4 show a downhole well cleaning tool 10 for use in collecting debris 12 from the bottom of a wellbore 14 having a lower portion thereof filled with fluid. The tool 10 features a drive sub 16 connected to the lower end of a series of interconnected upper sections 18 of a drill string that are lowered into the wellbore 14 and connected at their upper end to a suitable drive source above-ground for effecting reciprocation along, and rotation of the upper string sections 18 and the tool 10 connected thereto about, a central axis 20 of the well bore. A pump mandrel 22 projects downward from the drive sub 16 to carry a swab mandrel 24 at its lower end for reciprocation thereof within a pump barrel 26. The lower end of the pump barrel 26 is connected to a plurality of interconnected lower sections 28 of the drill string through a thread saver sub 27, the plurality of lower sections 28 having an inlet (not shown) communicating with the surrounding wellbore proximate the lower end 29 of the drill string. The lower sections 28 are equipped with a ball and seat check-valve 32 provided as part of a debris trapping check-valve sub, schematically illustrated at 33, connected between adjacent ones of the lower sections 28 of the drill string to allow fluid having entered the lower sections 28 through the inlet proximate the bottom end thereof from the wellbore to continue upward toward the pump barrel 26 only when a pressure differential between the fluid entering the lower sections from the surrounding wellbore and a portion of the hollow interior of the lower sections above the check valve 32 exceeds a predetermined amount.

The bottom end 29 of the drill string is equipped with a spade bit 31 for drilling and breaking up the debris 12 at the bottom of the wellbore 14 under driven rotation of the drill string, and the tool 10 mounted intermediately between the upper and lower sections thereof, by the drive source at the surface. The lower sections 28 are lowered into the fluid-filled lower portion of the wellbore so that the spade bit reach the debris 12 situated at the bottom thereof, the downward force from the drive source continuing to lower the upper section 18 and the attached pump mandrel 22 after the spade bit 31 reaches the debris 12, causing the pump mandrel 22 and the swab mandrel 24 to depend further down into the pump barrel 26 to a lowermost position therealong. From this position, shown in FIG. 3, an upstroke acts to lift the upper sections 18, raising the pump and swab mandrels back up within the pump barrel 26. During this upstroke, a swab cup, shown schematically at 30, seals between the swab mandrel 24 and the interior of the pump barrel wall, pulling fluid disposed above the swab cup upward therewith and thereby reducing pressure below the swab cup within the pump barrel 26 and the lower section 28. This pressure reduction opens the check valve 32, drawing debris-carrying fluid into the lower sections 28 through the inlet at the bottom 29 thereof, where the debris carried by the fluid is trapped to clean out the bottom of the wellbore. Most if not all of the debris is trapped above the check valve of a debris trapping sub because it is typically heavier than the water or other fluids. Different types of trapping subs are known within the art and may be readily applied within the lower sections of the string. If by some chance some debris gets into the sand pump and jams the unit up, the unit is pulled out of the well, flushed clean with water and run back in the well for further use.

Figure 7:
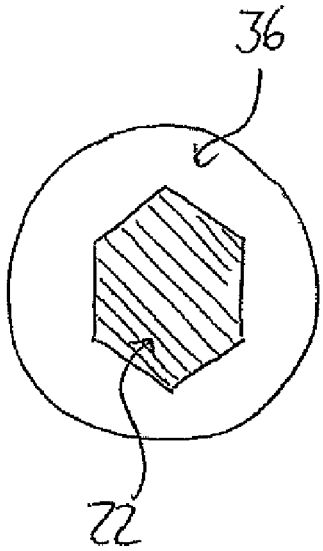
FIG. 7 is a cross section view of a pump mandrel of the well cleaning tool as taken along line 7-7 of FIG. 1.

Circumferentially spaced ports 34 extend radially through the side wall of the round pump barrel 26 to allow discharge of the fluid lifted upward by the swab cup 30 during the upstroke from the hollow interior of the pump barrel 26 into the surrounding wellbore 14. An upper wear bushing 36 connected to the upper end of the pump barrel 26 has a central hexagonal bore therethrough, through which the pump mandrel 22 of hexagonal cross section extends into the pump barrel 26 from thereabove, as shown in FIG. 7. The central bore of the upper wear bushing 36 acts to center the pump mandrel 22 within the pump barrel 26 during reciprocating movement therealong through the bore of the bushing, while the straight sided and similarly dimensioned cross sections of the bore and the pump mandrel prevent relative rotation between the pump mandrel 22 and the pump barrel 26 along their aligned central axes, which are shown as aligned with the central longitudinal axis 20 of the wellbore. This arrangement means that the upper wear bushing 36 and the pump barrel 26 to which it is fixed will rotate with the upper sections 18 of the drill string during driven rotation thereof by the drive source to transfer drive power down to the spade bit 31 while the swab mandrel 24 is able to reciprocate relative to the pump barrel 26 to operate the cleaning tool 10. The upper end of the pump barrel 26 is closed off by the upper wear bushing 36 between the pump mandrel 22 passing therethrough and the side wall of the pump barrel.

The interior surface of the pump barrel side wall is polished to provide a smooth surface for an effective seal with the swab cup 30. To assist the upper wear bushing 36 in maintaining parallel co-axial alignment of the pump mandrel 22 and the pump barrel 26, a lower wear bushing 38 is mounted on the pump mandrel 22 proximate a lower end thereof to project radially outward from the pump mandrel in the space between the pump mandrel and the surrounding pump barrel 26. In addition to maintaining alignment between the pump mandrel and barrel, the lower bushing 38 prevents direct contact between the pump mandrel 22 and the polished interior surface of the pump barrel wall so as to minimize wear and the potential for damage. The alignment provided by the bushings thus acts to increase the lifespan of the polished pump barrel. The lower bushing 38 does not off the entire space between the pump mandrel 22 and the pump barrel 26, as this would prevent passage of fluid therepast during lowering thereof during the downstroke of the tool. The lower bushing 38 thus defines a plurality of passages spaced circumferentially about the pump mandrel 22 and each extending therealong to allow passage of fluid from one side of the lower bushing 38 to the other opposite side thereof during lowering of the pump mandrel 22 through the fluid in the wellbore. These passages may be defined by grooves in the periphery of the lower bushing 38, gaps about the pump mandrel 22 dividing the effective bushing into separate sections or holes passing through the bushing along the pump mandrel 22 between their peripheries. In the embodiment detailed herein, the lower wear bushing is a single integral unit extending fully about the pump mandrel with eight grooves cut into the wear bushing and all equally spaced apart thereabout. The lower wear bushing illustrated has been screwed onto the threaded end of the hex shaft pump mandrel.

A swivel or knuckle joint 40 connects the lower end of the pump mandrel 22 to the upper end of the swab mandrel 24 to allow for a degree of flexibility between the two mandrels, for movement into and out of co-axial alignment of the two longitudinal components. The reason for having the knuckle is so when the cup travels up and down it is at least closer to being truly centered in the pump barrel, so that it is self aligned & free to a certain extent If the cup is not centered the cup will tend to wear out faster, plus binding may be a problem. Of course it should be kept in mind that the fluid is not 100% clean and clear because there are generally sediments in all the fluids in all wells. Also when one works with the hex shaft pump mandrel up and down, the unit experiences some degree of flex from side to side even with the lower wear bushing in the inside of the pump barrel. The cup it self spins when being forced. The wear bushing tends center the hex shaft pump mandrel, but the force on the down stroke is so great that the cup may spin and flex may take place. The use of both the knuckle and lower wear bushing has been found to provide the best results. Knuckle joints also allow quick disconnection of the parts they connect, thereby reducing the time and effort involved in disassembling the tool for cleaning, or repair or replacement of worn parts.

Figure 5:
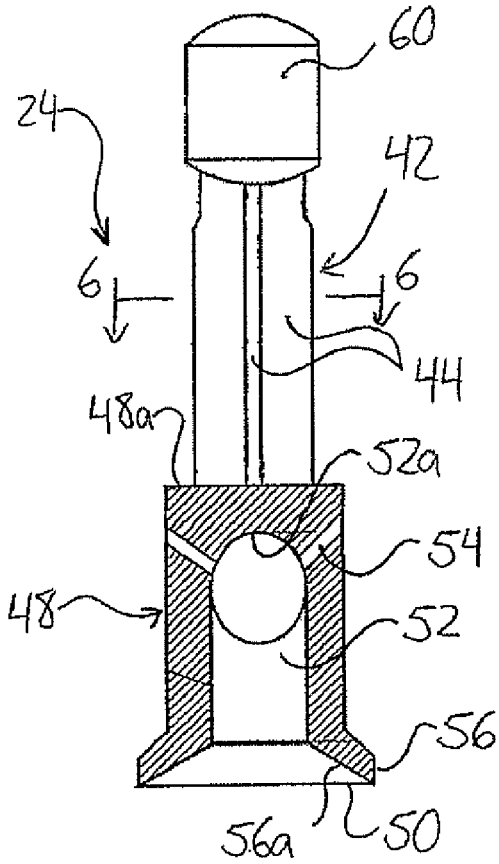
FIG. 5 is a side elevational view of a swab mandrel of the well cleaning tool with a lower stop body of the swab mandrel cut away for illustration.
Figure 6:
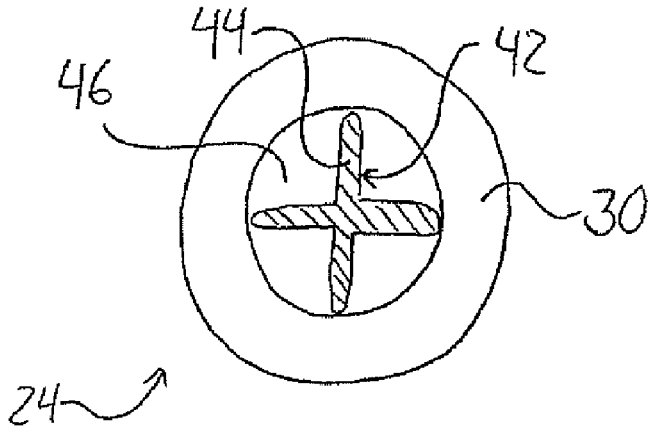
FIG. 6 is a cross sectional view of a slide body of the swab mandrel as taken along line 6-6 of FIG. 6 with a swab cup disposed about the slide body for illustration.

FIGS. 5 and 6 illustrate the swab mandrel 24 of the well cleaning tool of the present invention in further detail. The swab mandrel 24 includes an elongate slide body 42 of cruciform cross section, about which one or more swab cups 30 are disposed to be slidable along the slide body 42 with an outer diameter of the swab cup sealing with the inner surface of the pump barrel side wall during the tool's upstroke. The cruciform cross-sectional shape of the slide body 42 defines four ribs 44 separated by four channels 46, the ribs and channels extending along the slide body. With the swab cup 30 disposed about the swab mandrel slide body 42, the channels define pathways from one side of the swab cup to an opposite side thereof along the swab mandrel slide body 42 through which fluid can flow. These channels 46 allow transfer of fluid from below the swab cup 30 to above the swab cup as the swab mandrel 24 is lowered into the wellbore fluid, carried by the pump mandrel 22 and the upper string section 18 being driven downward under the effect of the drive source at the surface.

With the lowering of the swab mandrel 24 through the wellbore fluid within the pump barrel 26 until the drive sub 16 reaches the upper wear bushing 36 causing the relative positioning of some of the fluid to change from being below the swab cup 30 to above it, the weight of the fluid forces the swab cup 30 downward along the swab mandrel slide body 42 to a lowermost position therealong at which the swab cup comes to sit atop a stop body 48. The stop body 48 projects radially outward from the slide body 42 at the lower end thereof to define a continuous ledge extending thereabout of greater diameter than the central opening in the swab cup 30, so that when the swab up 30 is forced down under the weight of the water situated over it into engagement with the stop body 48 at the upper end 48*a* thereof, the central opening of the swab cup 30 is blocked thereby. With the swab mandrel 24 in its lowermost position along the pump barrel 26 at the end of the downstroke and the swab cup 30 accordingly positioned in its lowermost position along the swab mandrel slide body 42 under the weight of the fluid disposed above the swab cup, fluid cannot pass across the swab cup as the stop body 48 blocks access through the central opening of the swab cup, effectively closing off the bypass channels 46 defined between the ribs 44 of the slid body 42, and the outer periphery seals against the interior of the pump barrel side wall. This sealing action ensures that during the upstroke, the fluid disposed above the swab cup 30 remains thereabove and does not leak back down to below the swab cup, and therefore is lifted upward within the pump barrel 26 by the sealing swab cup being lifted with the swab and pump mandrels during the upstroke for discharge back out of the pump barrel through the outlet ports 34 in the side wall thereof near the upper end thereof.

The stop body 48, shown only schematically in FIGS. 1 to 4, is shown in more detail in FIG. 5 and acts to do more than just act as a stop and seal for limiting motion of and blocking fluid transfer across the swab cup 30. As shown in FIG. 5, the stop body 48 is hollowed out from a bottom end 50 thereof to form an interior cavity 52 extending upward into, but not through, the stop body 48 into which some of the wellbore fluid into which the swab mandrel is lowered enters during the downward stroke. Proximate an upper end 52*a* of the interior cavity 52, a plurality of conduits 54 extend laterally outward from the cavity 52 to the exterior periphery of the stop body 48 below an upper end 48*a* thereof at positions spaced angularly about he cavity and the side wall of the stop body 48 defining the exterior periphery thereof. The conduits 54 are each of a smaller diameter than the cavity 52 in the stop body 48 from which they extend, so that fluid passing into the conduits 54 from the cavity 52 during lowering of the swab mandrel 24 into the wellbore fluid within the pump barrel 25 below the swab cup 30 increases in velocity to create a jetting effect of fluid exiting the stop body 48 at the exterior periphery thereof outward to the surrounding interior surface of the pump barrel side wall. This jetting or spraying of fluid from the stop body 48 onto the surrounding side wall of the pump barrel 26 acts to clean any debris that may have built-up thereon as a result of some of the debris carried into the lower section 28 of the string escaping therefrom and flowing upward with fluid entering the pump barrel 26 from the lower section.

The conduits 54 do not extend in a purely radial direction outward from the central longitudinal axis of the swab mandrel 24, but rather are angled obliquely upward moving away therefrom. That is, the conduits 54 each slope upward from a radial plane normal to the longitudinal axis of the swab body in an outward direction from the cavity 52 toward the exterior periphery of the stop body 48. This angled orientation of the conduits encourages the fluid discharged therefrom against the interior surface of the pump barrel 26 to flow upward therealong to carry any debris freed by this jetting action upward toward the swab cup 30 for passage thereby through the bypass channels 46 of the swab mandrel slide body 42 bypassing the swab through the central opening therein during the downstroke of the tool. This debris freed from the interior of the pump barrel wall is thus subsequently discharged through the outlet ports 34 spaced about the pump barrel 26 proximate the upper end thereof.

The arrangement of the interior cavity opening into the stop body 48 at the lower end of the pump mandrel 22 and the smaller conduits extending outward therefrom thus provide the tool with a self-cleaning action for minimizing debris buildup within the pump barrel 26. This extends the amount of time the tool can be used within the wellbore before requiring removal and disassembly for a full cleaning thereof and further extends the lifespan of the tool by keeping it clean and helping maintain the smooth finish of its polished interior. As shown in FIG. 5, the interior cavity 52 of the stop body 48 may flare outward toward the lower end 50 thereof to increase the cross-sectional area of the cavity's inlet, or in other words increase the cross-sectional area covered by the lower end of the stop body 48 within the pump barrel interior. This increases the fraction of fluid within the pump barrel that is forced through the conduits to carry out cleaning of the interior of the pump barrel wall. As shown, this widening of the cavity inlet may be achieved by shaping the stop body to have its periphery 48 flare out to form an angled flange or skirt 56 projecting outward and downward toward the bottom end 50 of the stop body, rather than having a constant diameter over the full length of the stop body sufficiently large to facilitate the widened inlet of the cavity 52. Bottom surfaces 56*a* of the angled flange 56 slope upward moving inward from the outer periphery of the flange 56 to narrow the inlet portion of the cavity 52 defined at the bottom 50 of the stop body 48 toward an elongate constant-diameter portion of the cavity which may be domed at the top end thereof 52*a* as shown.

Figure 2:
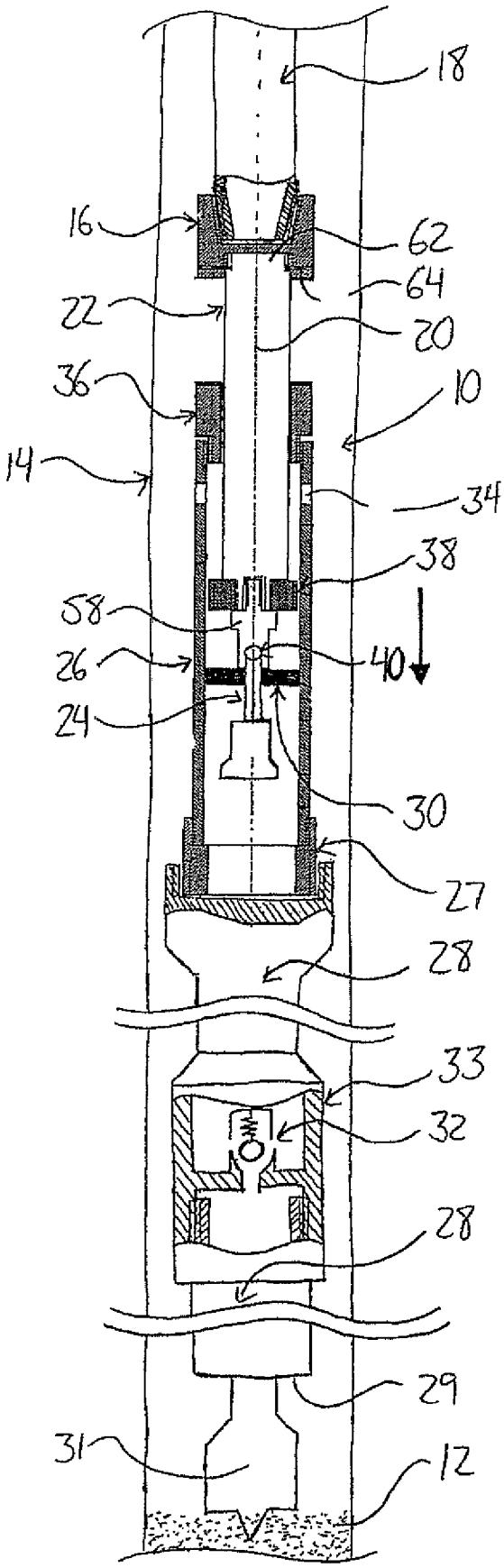
FIG. 2 is a schematic side elevational view of the well cleaning tool in the well bore during the down stroke.
Figure 3:
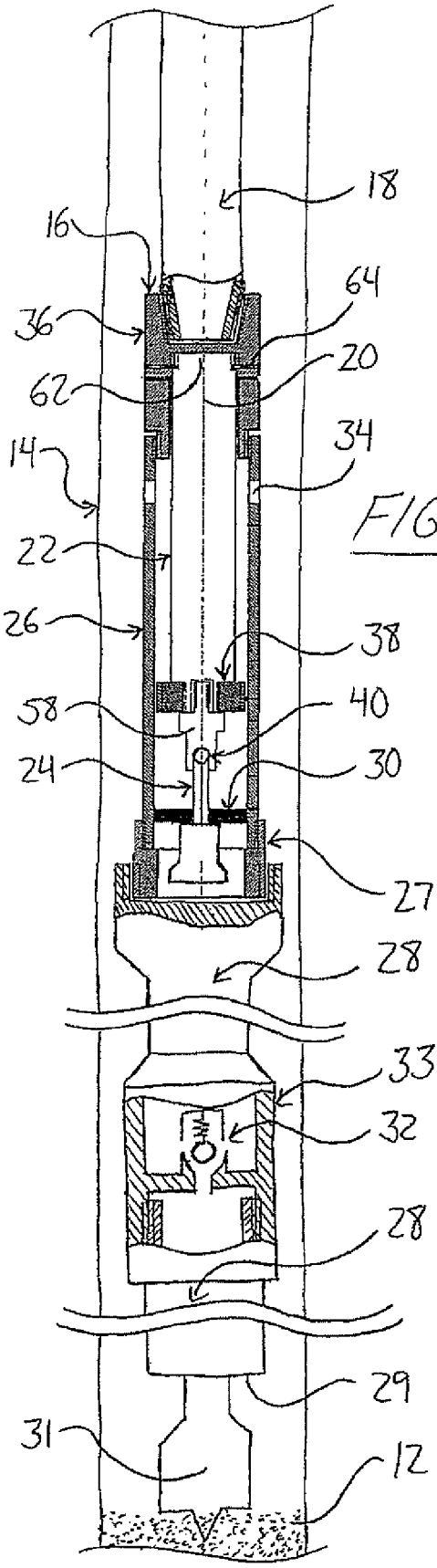
FIG. 3 is schematic a side elevational view of the well cleaning tool in the well bore with the pump mandrel of the cleaning tool in a lowermost position prior to an upstroke.
Figure 4:
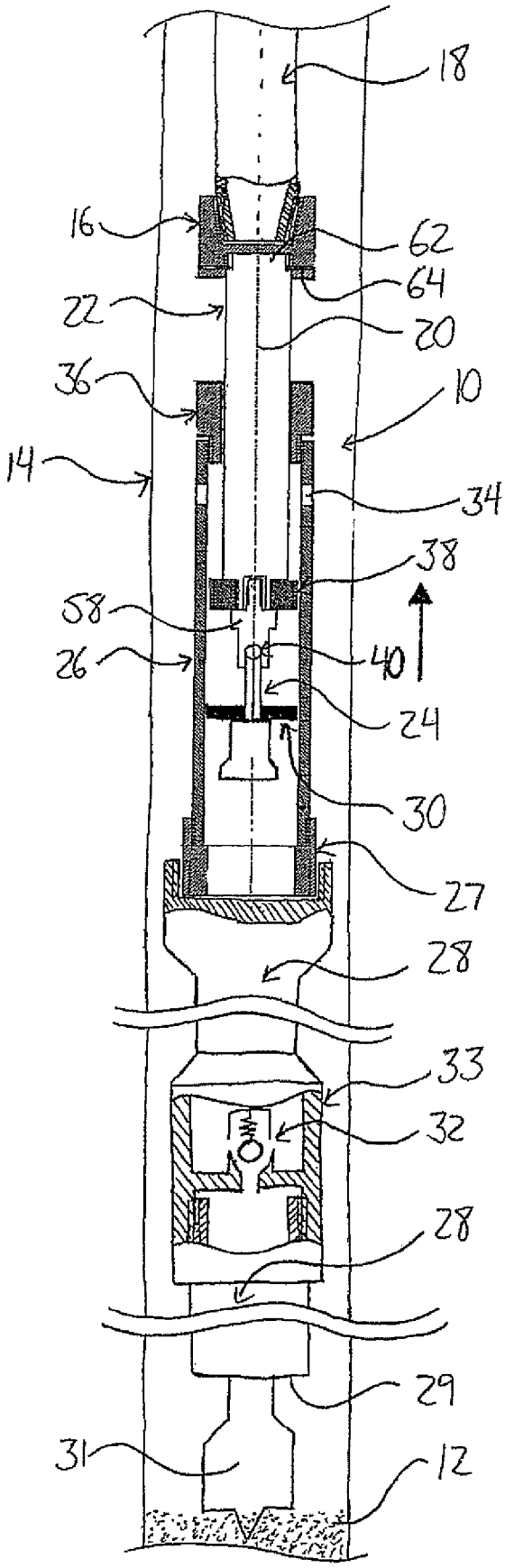
FIG. 4 is schematic a side elevational view of the well cleaning in the well bore during the upstroke.

As shown in FIG. 2, the uppermost position of the swab cup 30 along the slide body 42 of the swab mandrel 24 is defined by a stop formed by the lower end of the knuckle joint body 58 arranged to receive the joint end 60 of the swab mandrel 24 at the upper end thereof opposite the stop body 48. With the swab mandrel 24 and the knuckle joint body 58 fixed to the lower end of the pump mandrel 22 interconnected to define the knuckle joint 40, the lower end 58*a* of the knuckle joint body is disposed below the end of the bypass channels 46 defined by the ribs 44 of the cruciform slid body 42 atop which the joint end 60 of the swab mandrel is formed. The lower end 58*a* of the knuckle joint body 58 projects outward sufficiently from the central longitudinal axis of the joint body 58 to block sliding of the swab cup 30 upward past it, thereby defining an upper stop of the swab cup mandrel 24. As this upper stop is positioned below the upper ends of the bypass channels 46, fluid flow in the bypass channels through the central opening of the swab cup 30 is allowed with the sub cup in its uppermost position engaging against the lower end 58*a* of the knuckle joint body 58.

In the illustrated embodiment, the upper sections 18 of the drill string and the drive sub 16, the drive sub 16 and the pump mandrel 22, the upper wear bushing 36 and the pump barrel 26, the pump mandrel 22 and the knuckle joint body 58, the pump barrel 26 and the thread saver sub 27, the thread saver sub 27 and the lower sections 28 of the drill string, the lower sections 28 of the drill string and the check valve sub 33, are all interconnected by cooperating internal and external threads provided at the mating ends of these interconnecting component pairs. To provide such a fastening arrangement between the pump mandrel 22 and the drive sub 16, a top portion 62 of the pump mandrel 22 extending downward therefrom a short distance relative to the overall length of the pump mandrel does not share the hexagonal cross section featured over most of the pump mandrel's length, but instead has a circular cross section featuring an external thread formed about the periphery thereof. To aid in holding the pump mandrel 22 in place with the drive sub 16, the drive sub 16 features a plurality of threaded holes 64 extending thereinto from its periphery into the internally threaded hollow bottom portion into which the pump mandrel is threadingly received just below the internal threads of the drive sub 16. Set screws are threadingly received in the holes 64 to project into the hollow receiving portion extending into the bottom of the drive sub and engage into grooves in the pump mandrel periphery a short distance below the upper end thereof to lock the drive sub onto the hex shaft pump mandrel so that there is little to no chance of the two components coming apart and the drive sub backing off from the pump mandrel is reduced to a very slim possibility.

It will be appreciated by those of skill in the art that the spade bit may be replaced with another type of drill bit or other suitable equipment for drilling, penetrating or breaking up the debris built up at the bottom of the wellbore. It will also be appreciated that the number of swab cups and the number of drill pipe or tubing joints inserted below the pump barrel may be varied, preferably between ten and fifteen sections.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A downhole well cleaning tool adapted for connection between upper sections and a hollow lower section of an elongate string extendable down into a wellbore lower section first, the lower section comprising an inlet spaced from an end of the lower section nearest the upper sections and equipped with a check valve to selectively open and close the inlet and the upper section being connectable to a drive source operable to reciprocate the upper sections along the wellbore, the clean out tool comprising:

an elongate tubular pump barrel connectable at a lower end thereof in fluid communication with the hollow lower section of the elongate string and having at least one fluid outlet through a side wall near of the pump barrel proximate an upper end thereof, an elongate pump mandrel connectable at an upper end thereof to the upper sections of the elongate string and extending through the upper end of the pump barrel, the pump mandrel and the pump barrel being arranged to allow reciprocal motion of the pump mandrel relative to and along the pump barrel while preventing relation rotation between the pump barrel and the pump mandrel; and a swab assembly connected at an upper end thereof to a lower end of the pump mandrel and reciprocally contained within the pump barrel, the swab assembly comprising a swab mandrel having at least one longitudinal bypass channel extending therealong and a swab cup disposed about and slidable along the swab mandrel between upper and lower stops defined thereon to limit sliding motion of the swab between uppermost and lowermost positions in which fluid flow from one side of the swab cup to an opposite side thereof through the bypass channel is allowed and prevented respectively, the swab cup sealing against an interior of the side wall of the pump barrel in the lowermost position to seal off fluid flow from the one side of the swab cup to the opposite side thereof between the swab cup and the side wall of the pump barrel;

a lower portion of the swab mandrel being hollow and open at a lower end thereof, at least one conduit extending through a side wall of the swab mandrel to communicate an interior of the hollow lower portion thereof with an exterior thereof to direct fluid laterally outward from the interior of the hollow lower portion of the swab mandrel against the side wall of the pump barrel during lowering of the swab mandrel into fluid within the pump barrel.

2. The downhole well cleaning tool according to claim 1 wherein the at least one conduit extending through the side wall of the swab mandrel is angled obliquely upward from the interior of the hollow lower portion relative to a longitudinal axis of the swab mandrel.

3. The downhole well cleaning tool according to claim 1 wherein the at least one conduit comprises a plurality of conduits opening at an outer surface of the side wall of the swab mandrel at locations spaced about the periphery thereof.

4. The downhole well cleaning tool according to claim 1 wherein each conduit is smaller in diameter than the interior of the hollow lower portion of the swab mandrel.

5. The downhole well cleaning tool according to claim 1 wherein the interior of the hollow lower portion of the swab mandrel flares outwardly toward a lower end of the swab mandrel to define a maximum diameter of the interior at an inlet thereof.

6. The downhole well cleaning tool according to claim 1 comprising a movable joint connecting the pump mandrel and the swab mandrel to allow movement of the swab mandrel into and out of alignment with a longitudinal axis of the pump mandrel.

7. The downhole well cleaning tool according to claim 1 wherein the swab mandrel is connected to the to the pump mandrel by a knuckle or swivel joint.

8. The downhole well cleaning tool according to claim 1 further comprising a wear bushing mounted to the pump mandrel at a position therealong.

9. The downhole well cleaning tool according to claim 8 wherein the wear bushing is positioned proximate the lower end of the pump mandrel.

10. The downhole well cleaning tool according to claim 8 wherein the wear bushing has at least one passage extending from one side of the wear bushing to an opposite side of the wear bushing along the pump mandrel to allow fluid flow upward past the wear bushing.

11. The downhole well cleaning tool according to according to claim 10 wherein the at least one passage of the wear bushing comprises at least one groove in an outer periphery of the wear bushing.

12. The downhole well cleaning tool according to according to claim 8 wherein the wear bushing comprises a brass bushing.

13. The downhole well cleaning tool according to claim 1 wherein the pump mandrel and an opening in the closed upper end of the pump barrel each have a straight-sided cross-sectional shape.

14. The downhole well cleaning tool according to claim 1 further comprising a drive sub connecting the pump mandrel and the upper sections of the elongate string, the drive sub receiving the upper end of the pump mandrel in a hollow receiving end of the drive sub and having holes projecting from a periphery of the drive sub into the hollow receiving end to receive set screws for engagement thereof with the pump mandrel proximate the upper end thereof.

15. The downhole well cleaning tool according to claim 14 wherein the pump mandrel comprises recesses in a periphery thereof proximate the upper end of the pump mandrel at spaced positions thereabout to receive engagement ends of the set screws.

16. The downhole well cleaning tool according to claim 1 wherein each longitudinal bypass channel is defined at the periphery of the swab mandrel, fluid flow along each longitudinal bypass delivering fluid through a central opening in the swab cup between the swab cup and the swab mandrel.

17. The downhole well cleaning tool according to claim 16 wherein the swab mandrel is cruciform in cross section, thereby defining four longitudinal bypasses.

18. The downhole well cleaning tool according to claim 1 in combination with the lower section of the elongate string, the check valve of the lower section comprising a ball check valve.

19. A downhole well cleaning tool adapted for connection between upper sections and a hollow lower section of an elongate string extendable down into a wellbore lower section first, the lower section comprising an inlet spaced from an end of the lower section nearest the upper sections and equipped with a check valve to selectively open and close the inlet and the upper section being connectable to a drive source operable to reciprocate the upper sections along the wellbore, the clean out tool comprising:

an elongate tubular pump barrel connectable at a lower end thereof in fluid communication with the hollow lower section of the elongate string and having at least one fluid outlet through a side wall near of the pump barrel proximate an upper end thereof, an elongate pump mandrel connectable at an upper end thereof to the upper sections of the elongate string and extending through the upper end of the pump barrel, the pump mandrel and the pump barrel being arranged to allow reciprocal motion of the pump mandrel relative to and along the pump barrel while preventing relation rotation between the pump barrel and the pump mandrel;

a swab assembly connected at an upper end thereof to a lower end of the pump mandrel and reciprocally contained within the pump barrel, the swab assembly comprising a swab mandrel having at least one longitudinal bypass channel extending therealong and a swab cup disposed about and slidable along the swab mandrel between upper and lower stops defined thereon to limit sliding motion of the swab between uppermost and lowermost positions in which fluid flow from one side of the swab cup to an opposite side thereof through the bypass channel is allowed and prevented respectively, the swab cup sealing against an interior of the side wall of the pump barrel in the lowermost position to seal off fluid flow from the one side of the swab cup to the opposite side thereof between the swab cup and the side wall of the pump barrel; and a wear bushing mounted to the pump mandrel at a position therealong and having at least one passage extending from one side of the wear bushing to an opposite side of the wear bushing along the pump mandrel to allow fluid flow upward past the wear bushing.

20. A downhole well cleaning tool adapted for connection between upper sections and a hollow lower section of an elongate string extendable down into a wellbore lower section first, the lower section comprising an inlet spaced from an end of the lower section nearest the upper sections and equipped with a check valve to selectively open and close the inlet and the upper section being connectable to a drive source operable to reciprocate the upper sections along the wellbore, the clean out tool comprising:

an elongate tubular pump barrel connectable at a lower end thereof in fluid communication with the hollow lower section of the elongate string and having at least one fluid outlet through a side wall near of the pump barrel proximate an upper end thereof, an elongate pump mandrel connectable at an upper end thereof to the upper sections of the elongate string and extending through the upper end of the pump barrel, the pump mandrel and the pump barrel being arranged to allow reciprocal motion of the pump mandrel relative to and along the pump barrel while preventing relation rotation between the pump barrel and the pump mandrel;

a swab assembly connected at an upper end thereof to a lower end of the pump mandrel and reciprocally contained within the pump barrel, the swab assembly comprising a swab mandrel having at least one longitudinal bypass channel extending therealong and a swab cup disposed about and slidable along the swab mandrel between upper and lower stops defined thereon to limit sliding motion of the swab between uppermost and lowermost positions in which fluid flow from one side of the swab cup to an opposite side thereof through the bypass channel is allowed and prevented respectively, the swab cup sealing against an interior of the side wall of the pump barrel in the lowermost position to seal off fluid flow from the one side of the swab cup to the opposite side thereof between the swab cup and the side wall of the pump barrel; and a movable joint connecting the pump mandrel and the swab mandrel to allow movement of the swab mandrel into and out of alignment with a longitudinal axis of the pump mandrel.

* * * * *